US008170435B2

(12) United States Patent
Ueno

(10) Patent No.: US 8,170,435 B2
(45) Date of Patent: May 1, 2012

(54) BELT DRIVING MECHANISM, FIXING DEVICE, IMAGE FORMING APPARATUS USING SAME, AND BELT POSITION ADJUSTMENT METHOD USED THEREIN

(75) Inventor: Satoshi Ueno, Komae (JP)

(73) Assignee: Ricoh Company Limited, Tokyo (JP)

( * ) Notice: Subject to any disclaimer, the term of this patent is extended or adjusted under 35 U.S.C. 154(b) by 185 days.

(21) Appl. No.: 12/640,611

(22) Filed: Dec. 17, 2009

(65) Prior Publication Data

US 2010/0158553 A1 Jun. 24, 2010

(30) Foreign Application Priority Data

Dec. 24, 2008 (JP) ..... 2008-327278

(51) Int. Cl.
*G03G 15/20* (2006.01)

(52) U.S. Cl. ..... 399/67

(58) Field of Classification Search ..... 399/67, 399/329, 122, 121, 125, 166, 320, 331, 339
See application file for complete search history.

(56) References Cited

U.S. PATENT DOCUMENTS 7,266,336 B2 9/2007 Ueno et al.
7,428,390 B2 * 9/2008 Ando ..... 399/67
7,450,872 B2 11/2008 Ueno et al.
7,491,917 B2 2/2009 Ueno
2006/0029411 A1 2/2006 Ishii et al.
2006/0257180 A1 * 11/2006 Nakagawa et al. ..... 399/329
2007/0014600 A1 1/2007 Ishii et al.
2007/0201916 A1 8/2007 Ueno
2008/0219721 A1 9/2008 Ito et al.
2008/0226326 A1 9/2008 Seo et al.
2008/0232873 A1 9/2008 Ueno et al.

FOREIGN PATENT DOCUMENTS

JP 9-218601 8/1997
JP 2001-194922 7/2001
JP 2005-208211 8/2005
JP 2008169047 A * 7/2008

* cited by examiner

*Primary Examiner* — Kiho Kim
(74) *Attorney, Agent, or Firm* — Oblon, Spivak, McClelland, Maier & Neustadt, L.L.P.

(57) ABSTRACT

A belt driving mechanism includes an endless belt wound around first and second belt supporters, rotated by a driving source, a pressure member that presses against the first belt supporter via the endless belt, a deviation detector to detect a deviation of the endless belt in its thrust direction, a cam mechanism including a rotary cam shaft extending the thrust direction of the endless belt and a first pressure change member of irregular shape, and a controller to changes a rotational position of the first pressure change member according to a detection result by the deviation detector. The first pressure change member has multiple different lengths of radii between a center portion of the cam shaft and its outer circumference and is attached to the cam shaft to press a first end portion of one of the first belt supporter and the pressure member.

18 Claims, 9 Drawing Sheets

BELT DRIVING MECHANISM, FIXING DEVICE, IMAGE FORMING APPARATUS USING SAME, AND BELT POSITION ADJUSTMENT METHOD USED THEREIN

CROSS-REFERENCE TO RELATED APPLICATIONS

This patent specification is based on and claims priority from Japanese Patent Application No. 2008-327278, filed on Dec. 24, 2008 in the Japan Patent Office, which is hereby incorporated by reference herein in its entirety.

BACKGROUND OF THE INVENTION

1. Field of the Invention

The present invention generally relates to a belt driving mechanism, an image forming apparatus, such as a copier, a printer, a facsimile machine, or a multifunction machine including at least two of these functions, that includes the belt driving mechanism, and a belt position adjustment method.

2. Discussion of the Background Art

In general, electrophotographic image forming apparatuses, such as copiers, printers, facsimile machines, or multifunction devices including at least two of those functions, etc., include an image carrier on which an electrostatic latent image is formed, a development device to develop the latent image with developer, a transfer unit to transfer the developed image (toner image) onto a sheet of recording media, and a fixing device to fix the toner image on the sheet with heat and pressure.

Fixing devices typically includes a heat source, a heating member (e.g., heating roller) to transmit heat from the heat source to the toner image formed on the sheet, and a pressure member (e.g., pressure roller, pad, etc.) that presses against the heating member, thus forming a fixing nip with the fixing member. Alternatively, the pressure member may press against the heating member via a fixing member.

Such electrophotographic image forming apparatuses typically use belts and driving mechanisms thereof for various purposes in addition to power transmission and transportation.

For example, certain known electrophotographic image forming apparatuses use a belt as the fixing member or heating member because the smaller heat capacity of the belt makes it possible to reduce the warm-up time of the fixing device, that is, the time period required to heat the fixing member to a target temperature. Shortening the warm-up time of the fixing device is important to reduce waiting time of the image forming apparatus from when users turn on the apparatus, particularly in the morning, to when and the apparatus is ready for image formation.

Certain known fixing devices use, as the fixing member, a belt (hereinafter "fixing belt") stretched around at least two rotary members (e.g., a first rotary member and a second rotary member), which together form a belt driving mechanism. The first rotary member has a lower thermal conductivity and is disposed facing a third rotary member via the belt, thus forming a fixing nip. The heat source is disposed inside the second rotary member. As the heat source, induction heating units are known in addition to heaters. The induction heating units typically use material having a smaller heat capacity as the fixing member and heat the fixing member through an inducting heating method. Hereinafter fixing devices using the fixing belt are referred to as "belt fixing devices".

Because the fixing belt having a smaller heat capacity can be heated relatively quickly, the warm-up time of such fixing devices can be shorter. In certain known fixing devices, the fixing belt is wound around the heating roller inside which the heat source is provided, and a tension roller, serving as the pressure member, is pressed against an outer surface of the fixing belt so that a relatively large area of the fixing belt contacts the heating roller. Thus, a large amount of heat can be transmitted to the fixing belt in a shorter time period, thereby reducing the warm-up time of the fixing device.

The belt driving mechanism should prevent any positional deviation in a width direction or thrust direction of the belt from occurring or correct it when it occurs, and it is known that positional deviation in a thrust direction of the belt tends to occur in image forming apparatuses. For example, in certain known image forming apparatus, an intermediate transfer belt is wound around multiple rollers including an upstream roller disposed on an upstream side in a direction in which the intermediate transfer belt rotates, and the intermediate transfer belt is biased to a first end of the upstream roller in a thrust direction of the upstream roller. A stopper is provided on an end portion of the intermediate transfer belt opposite the first end of the upstream roller. With this configuration, the intermediate transfer belt is biased in a predetermined direction and the stopper provided on the intermediate transfer belt contacts the other end of the tension roller to set the position of the intermediate transfer belt in the width direction. It is known that the position of the belt deviates in the width direction when pressing force of rollers each pressing against the belt is not balanced in the thrust direction.

It is to be noted that a disengaging unit to disengage one of the rollers pressing against each other from the other roller to adjust the pressing force of the rollers is known. For example, in certain known fixing devices in which the pressure roller directly presses against the fixing roller without any belt, the pressure roller is disengaged from the fixing roller when sheets are jammed between the two rollers to facilitate removal of the sheets therefrom. Although, typically, a cover of the apparatus is opened and then a lever is operated to move one of the fixing roller and the pressure roller, an arrangement in which the image forming apparatus includes a disengaging unit using a cam can be used. The disengaging unit using the cam is advantageous in that users do not need to open the cover. Additionally, the operational life of the fixing roller can be extended by simply operating the disengaging unit to disengage the fixing roller from the pressure roller when sheets do not pass therebetween. However, this disengaging unit does not consider the balance of the pressing forces between the two rollers.

In view of the foregoing, there is a need to prevent, reduce, or correct the positional deviation of the belt with a simple configuration which known methods fail to do.

SUMMARY OF THE INVENTION

In view of the foregoing, in one illustrative embodiment of the present invention, a belt driving mechanism includes first and second belt supporters, an endless belt rotatably wound around the first and second belt supporters, a driving source connected to one of the first and second belt supporters to rotate the endless belt, a pressure member pressing against the first belt supporter via the endless belt, forming a nip therebetween, a deviation detector to detect a deviation of the endless belt in a thrust direction of the endless belt, a cam mechanism to adjust pressure between the pressure member and the first belt supporter between both end portions thereof in the thrust direction of the endless belt, and a controller. The cam mechanism includes a rotary cam shaft extending in a direction parallel to the thrust direction of the endless belt, and a first pressure change member of irregular shape having multiple different lengths of radii between a center portion of the cam shaft and an outer circumference of the first pressure change member. The first pressure change member is attached to the cam shaft, to press a first end portion of one of the first belt supporter and the pressure member in the thrust direction toward the nip. The controller changes a rotational position of the first pressure change member by rotating the cam shaft according to a detection result generated by the deviation detector.

In another illustrative embodiment, a fixing device to fix a toner image on a recording medium includes the above-described driving mechanism. One of the first belt supporter and the pressure member between which the endless belt is disposed is used as a fixing member to be heated by a heating source and to transmit the heat to the toner image on the recording medium.

Yet another illustrative embodiment provides an image forming apparatus in which the above-described fixing device is incorporated.

Yet another illustrative embodiment provides a method of adjusting a position of an endless belt in the belt driving mechanism described above.

The method includes detecting a deviation of the endless belt in a thrust direction, and adjusting pressure between the first belt supporter and the pressure member between the first end portion and a second end portion opposite the first end portion in the thrust direction of the endless belt. The step of adjusting includes a step of maintaining a substantially identical pressure between the first belt supporter and the pressure member between the both end portions in the thrust direction by adjusting a pressing force exerted by the cam mechanism when no deviation of the endless belt in the thrust direction is detected, and a step of making the pressure between the first belt supporter and the pressure member different between the both end portions in the thrust direction while endless belt rotates by changing the pressing force exerted by the cam mechanism according to a detection result generated by the deviation detector when the deviation of the endless belt in the thrust direction is detected.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
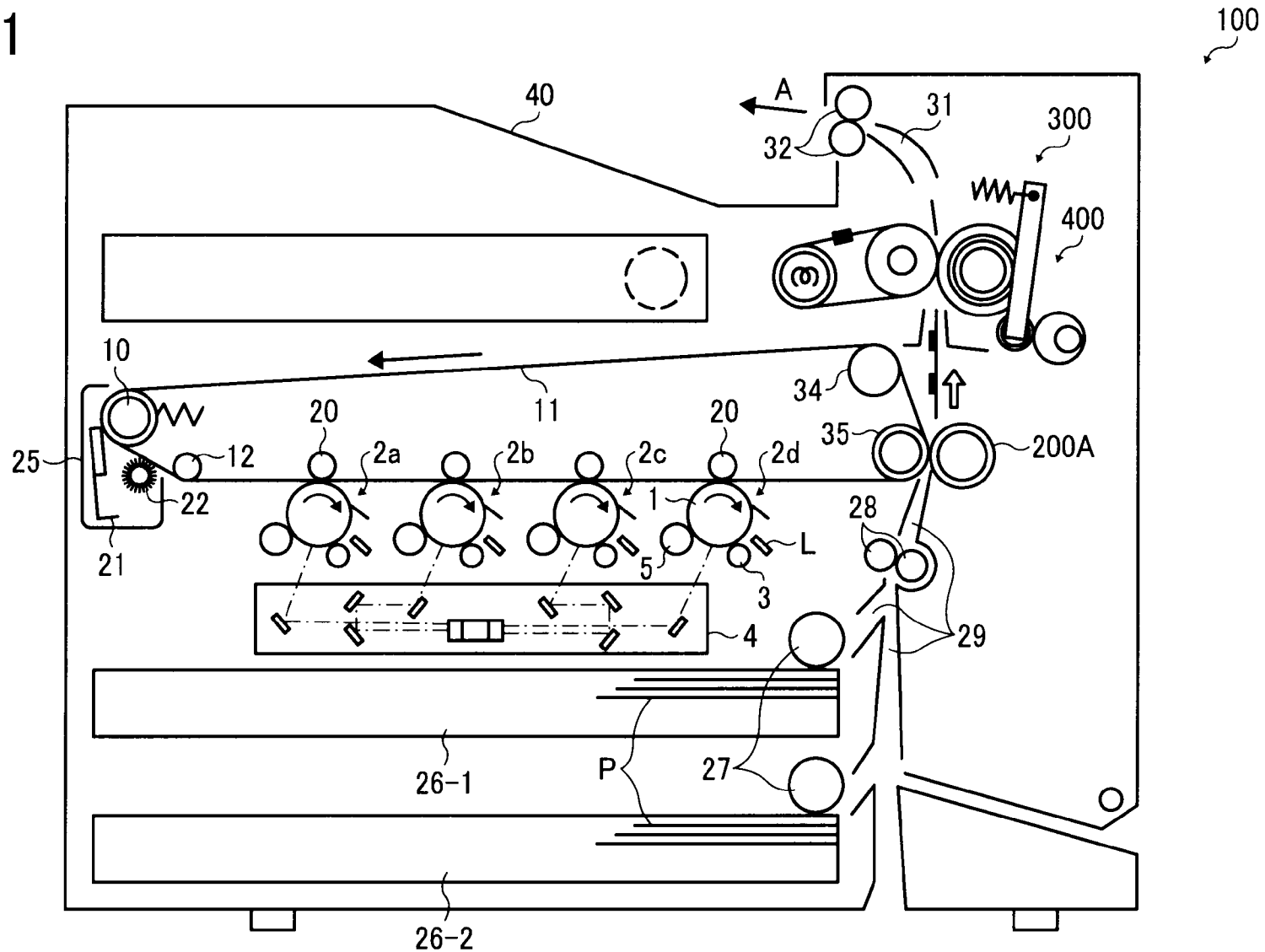
FIG. 1 is a schematic cross-sectional diagram illustrating a configuration of an image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a color image forming system according to an illustrative embodiment of the present invention is described.

First Embodiment

Specific features of the present embodiment are that a deviation detector to detect the deviation of a fixing belt in a thrust direction is used, and that a cam to press one of a pressure roller and a fixing roller has different shapes on both sides of a cam shaft. A cam driving controller adjusts the rotational position of the cam while the fixing belt rotates according to detection results generated by the deviation detector.

FIG. 1 is a schematic cross-sectional diagram illustrating a configuration of an image forming apparatus 100 according to a first embodiment of the present invention. Basic configurations and operations thereof are described below. It is to be noted that the basic configuration and the operation of the image forming apparatus 100 are similar to known electrophotographic image forming apparatuses, and thus details thereof are omitted in the description below.

Referring to FIG. 1, the image forming apparatus 100 is a tandem type intermediate-transfer electrophotographic image forming apparatus and can be, for example, a multicolor printer. An endless belt-shaped intermediate transfer member (hereinafter "intermediate transfer belt") 11 is provided in a center portion of the image forming apparatus 100. The intermediate transfer belt 11 is multilayered and includes a base layer formed of a material, such as polyvinylidene fluoride sheet or polyimide resin, that is less stretchy, and a smooth coat layer formed of, for example, fluoroplastic covers a surface of the intermediate transfer belt 11. The intermediate transfer belt 11 is wound around a driving roller 34 and rollers 10, 12, and 35 and is rotatable counterclockwise in FIG. 1, which is hereinafter referred to as "belt rotational direction".

The image forming apparatus 100 further includes a belt cleaning unit 25 disposed on the left of the roller 10 in FIG. 1, four image forming units 2*a*, 2*b*, 2*c*, and 2*d* (hereinafter collectively "image forming units 2") disposed above a portion of the intermediate transfer belt 11 stretched around the rollers 12 and 35, and an exposure unit 4 disposed beneath the image forming units 2.

The belt cleaning unit 25 removes any toner remaining on the intermediate transfer belt 11 after image transferring. The intermediate transfer belt 11, rollers 10, 12, 34, and 35, the belt cleaning unit 25, and primary transfer rollers 20 together form an intermediate transfer unit.

The image forming units 2*a*, 2*b*, 2*c*, and 2*d* form magenta, cyan, yellow, and black toner images, respectively, and are arranged along intermediate transfer belt 11 in that order in the belt rotational direction. The image forming units 2*a*, 2*b*, 2*c*, and 2*d* together form a tandem image forming unit. Each image forming unit 2 includes a photoconductor 1, a charging unit 3, and a development device 5.

Additionally, a secondary transfer unit 200A that in the present embodiment is a roller (hereinafter "secondary transfer roller 200A") is provided downstream from the primary transfer rollers 20 in the belt rotational direction. The secondary transfer roller 200A presses against the roller 35 via the intermediate transfer belt 11, forming a secondary transfer nip therebetween, and transfers a toner image from the intermediate transfer belt 11 onto a sheet P of recording media passing through the secondary transfer nip, after which, the sheet P is transported to a fixing device 300 by a transport member, not shown. The fixing device 300 is disposed above the secondary transfer roller 200A and fixes the toner image transferred onto the sheet P thereon. A cam mechanism 400 to correct deviation of a fixing belt 304 (shown in FIG. 2) is disposed on the right of the fixing device 300 in FIG. 1.

In FIG. 1, reference characters 31, 32, and 40 represent a discharge path, a pair of discharge rollers, and a discharge tray, respectively.

The belt cleaning unit 25 includes a cleaning blade 21, a brush roller 22 that is a rotary roller-shaped brush to lubricate the intermediate transfer belt 11. The belt cleaning unit 25 further includes a solid lubricant and a pressure spring to bias the solid lubricant toward the brush roller 22 although they are not shown in FIG. 1. The brush roller 22 scrapes the solid lubricator and applies the scraped lubricant onto a surface of the intermediate transfer belt 11 while rotating. The cleaning blade 21 is disposed to contact the intermediate transfer belt 11 and scrapes off any toner remaining thereon after image transferring. Thus, the belt cleaning unit 25 serves as both a cleaning unit to clean the intermediate transfer belt 11 and a lubrication unit to lubricate the surface of the intermediate transfer belt 11.

The image forming apparatus 100 further includes sheets cassettes 26-1 and 26-2 each containing multiple sheets P, feed rollers 27 to feed the sheets P from the sheets cassettes 26-1 and 26-2, a pair of registration rollers 28, and a transport path 29, which together form a sheet feed unit. The sheet cassettes 26-1 and 26-2 are arranged vertically.

Next, an image forming operation performed by the above-described image forming apparatus 100 is described below. When users press a start switch, not, shown, the roller 34 is rotated by a driving motor, not shown, and accordingly the other rollers 10, 12, and 35 are rotated. Thus, the intermediate transfer belt 11 is rotated. Simultaneously, in each image forming unit 2, the charging unit 3 charges a surface of the photoconductor 1 uniformly while the photoconductor 1 rotates.

Then, the exposure unit 4 directs writing light (laser beams) onto the surfaces of the photoconductors 1 according to image data, thus forming electrostatic latent images on the respective photoconductors 1.

Then, the development device 5 in each image forming unit 2 develops the latent image into a toner image, and thus magenta, cyan, yellow, and black single-color toner images are formed on the respective photoconductors 1. While the intermediate transfer belt 11 rotates, the primary transfer rollers 20 sequentially transfer the single-color toner images from the respective photoconductors 1 and superimpose the them one on another on the intermediate transfer belt 11, thus forming a multicolor toner image.

Meanwhile, when the start switch is pressed, in the sheet feed unit, one of the feed rollers 27 that corresponds to the sheet cassettes 26-1 or 26-2 containing sheets that match either a current setting or sheet size that is detected automatically is selectively rotated. Thus, the sheets P corresponding to the sheet size are sent one by one to the transport path 29.

The sheet P transported along the transport path 29 is stopped by the registration rollers 28. Then, the registration rollers 28 forward the sheet P to the secondary transfer nip, where the secondary transfer roller 200A presses against the intermediate transfer belt 11, timed to coincide with the arrival of the multicolor toner image formed on the intermediate transfer belt 11, and the multicolor toner image is secondarily transferred onto the sheet P in the secondary transfer nip, after which the sheet P is transported to the fixing device 300, where the toner image transferred onto the sheet P is fixed thereon with heat and pressure.

Then, the discharge rollers 32 discharge the sheet P in a direction indicated by arrow A shown in FIG. 1 onto the discharge tray 40 formed on an upper face of the image forming apparatus 100. Meanwhile, the belt cleaning unit 25 removes any toner remaining on the intermediate transfer belt 11 from which the image is transferred, and the intermediate transfer belt 11 is prepared for a subsequent image formation by the tandem image forming unit.

Figure 2:
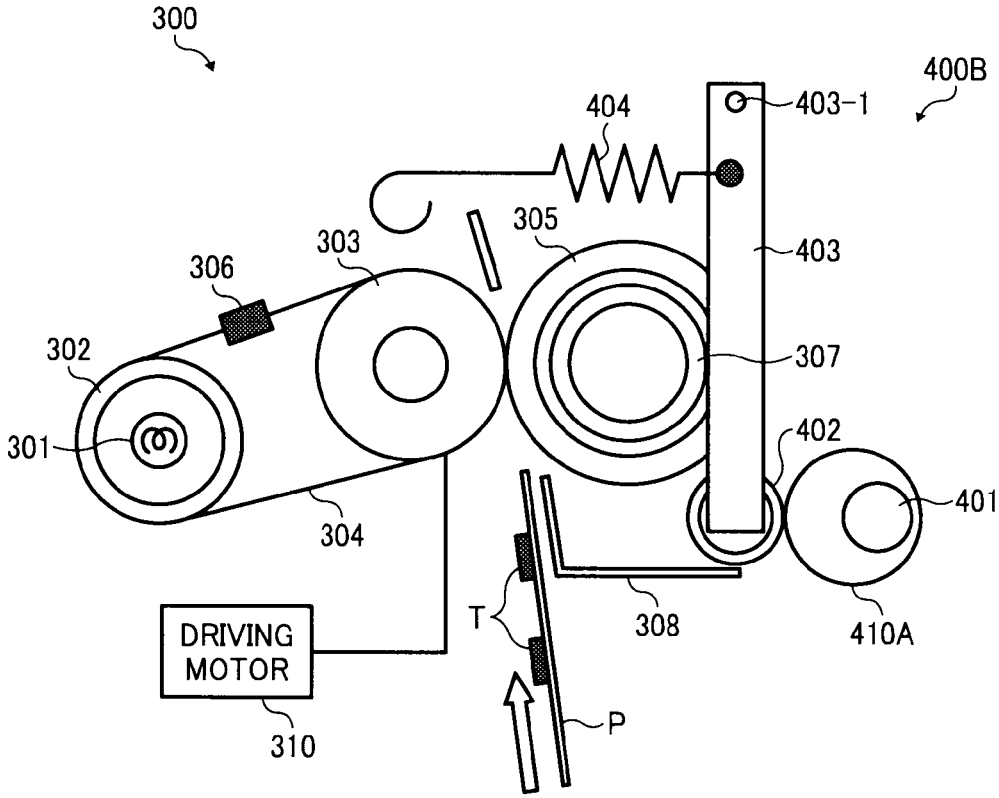
FIG. 2 is a side view that schematically illustrates a fixing device according to one illustrative embodiment.
Figure 3:
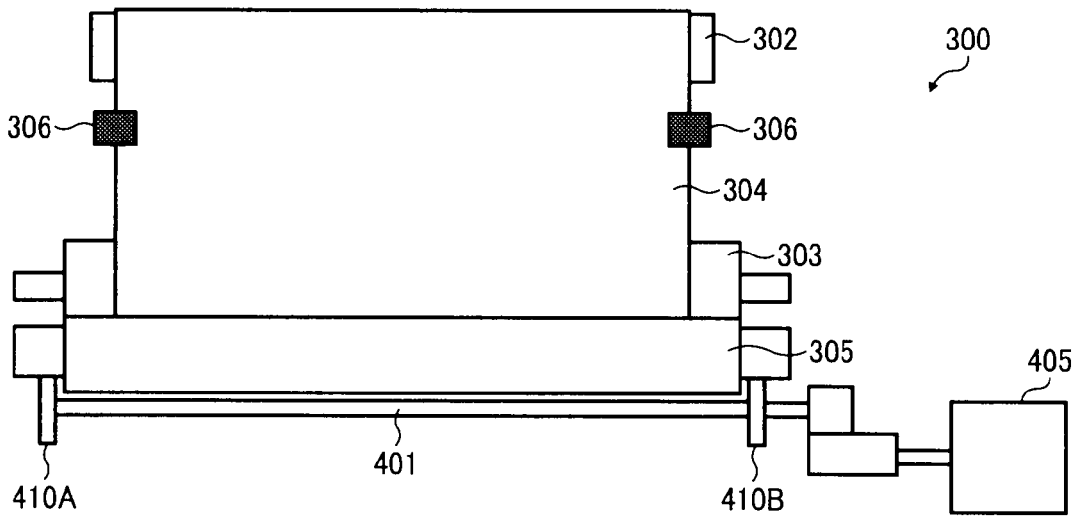
FIG. 3 is a top view that schematically illustrates the fixing device shown in FIG. 2.

FIGS. 2 and 3 are respectively a side view and a top view illustrating a schematic configuration of the fixing device 300 according to the first embodiment. The fixing device 300 that is a specific feature of the present embodiment is described in further detail below with reference to FIGS. 2 and 3.

As shown in FIGS. 2 and 3, the fixing device 300 includes a heating roller 302 in which a heater 301 is provided, a fixing roller 303, the fixing belt 304 stretched around the heating roller 302 and the fixing roller 303, a pressure roller 305 pressing against the fixing roller 303 via the fixing belt 304, forming a fixing nip therebetween. Thus, the fixing device 300 employs a heat fixing-belt method. When the sheet P carrying a toner image T passes between the fixing belt 304 and the pressure roller 305, its image side faces the fixing belt 304.

In this configuration, the fixing belt 304 serves as an endless belt, the fixing roller 303 and the heating roller 302 respectively serve as a first belt supporter and a second belt support roller around which the endless belt is wound, and the pressure roller 305 serves as a pressure member pressing against the first belt supporter via the endless belt. The fixing roller 303 is connected to a driving motor 310, serving as a driving source, and is driven thereby, and thus the fixing belt 304 sandwiched between the fixing roller 303 (first belt supporter) and the pressure roller 305 (pressure member) is rotated in a predetermined direction. It is to be noted that, although the fixing roller 303 serves as a driving roller to rotate the fixing belt 304 in the configuration shown in FIG. 2, alternatively, the heating roller 302 may serve as a driving roller connected to the driving motor 310 and the fixing roller 303 may serve as a driven roller.

As shown in FIG. 3, a deviation detector 306 is disposed to face each end portion in a width direction of the fixing belt 304. A pair of cam mechanisms 400A and 400B, together forming the cam mechanism 400, are provided close to both end portions in its axial direction (thrust direction) of the pressure roller 305 although only the cam mechanism 400B provided on the left in FIG. 3 is illustrated in FIG. 2. The cam mechanism 400 adjusts the pressing force of the pressure roller 305 against the fixing roller 303 (fixing belt 304) between both end portions by pressing respective journal portions, that is, portions inside bearings provided both end portions in the axial direction of the pressure roller 305 so as to correct positional deviation in the thrust direction of the fixing belt 304. The cam mechanism 400A includes a cam 410A attached to a first end portion (left side in FIG. 3) of the cam shaft 401, and the cam mechanism 400B includes a cam 410B attached to a second end portion (right side in FIG. 3) of the cam shaft 401. Hereinafter the cams 410A and 410B are also referred to the left and right cams 410A and 410B.

It is to be noted that hereinafter "end portion of the pressure roller 305, the fixing belt 304, or the fixing roller 303" means that in the axial direction (thrust direction) unless otherwise specified.

Each of the cam mechanisms 400A and 400B uses a plate cam as the cam (cam body) 410A or 410B and further includes a plate-like lever (arm) 403 and a cam follower 402. A first end portion in a longitudinal direction of the lever 403 is hinged to a housing of the fixing device 300, a plate of the image forming apparatus 100, or the like so that the lever 403 is rotatable around a support point 403-1, and the cam follower 402 is attached to a second end portion of the lever 403. The cam followers 402 rotate while contacting the respective cams 410A and 410B. A center portion of the lever 403 contacts a roller bearing 307 supporting the pressure roller 305. The lever 403 is biased by a pressure spring 404 toward the fixing roller 303 and thus biases the pressure roller 305 toward the fixing roller 303 via the roller bearing 307.

In the present embodiment, the cam mechanisms 400A and 400B share the cam shaft 401, that is, the left cam 410A and the right cam 410B are attached to an identical shaft coaxially, and both the cam 410A and 410B are driven by a single actuator 405 shown in FIG. 3. Therefore, the cost of cam mechanism 400 can be lower.

Additionally, a cam driving control circuit 18 (shown in FIG. 5) to control the actuator 405 is provided on an electronic circuit board, not shown. Thus, the cam mechanism 400 shown in FIGS. 2 and 3 uses the cam followers 402 and the levers 403 so that the right and left cams 410A and 410B press the respective journal portions of the pressure roller 305 via the lever 403. Additionally, pulling force of the pressure spring 404 is given to the lever 403, and thus the spring 404 biases the pressure roller 305 to the fixing nip. Alternatively, the cam mechanism may be configured so that the right and left cams 410A and 410B directly press the respective end portions of the roller bearing 307 supporting the pressure roller 307 without using lever and the like. In this case, a given bias member causes a sliding contact surface of the cam to constantly contact a component that presses against the cam. Alternatively, the right and left cam mechanisms can use separate cam shafts and be driven by separate driving sources. In this case, the right and left cam mechanisms should be controlled to rotate in synchronization.

It is to be noted that, although the cam mechanism 400 is provided on the side of the pressure roller 305 in the present embodiment, the cam mechanism 400 may be provided on the side of the fixing roller 302 to adjust the pressing force between the pressure roller 305 and the fixing roller 302 (fixing belt 304) in the both end portions.

The cams 410A and 410B (hereinafter simply "cams A and B") are described in further detail below with reference to FIGS. 4A, 4B, and 4C.

Figure 4A:
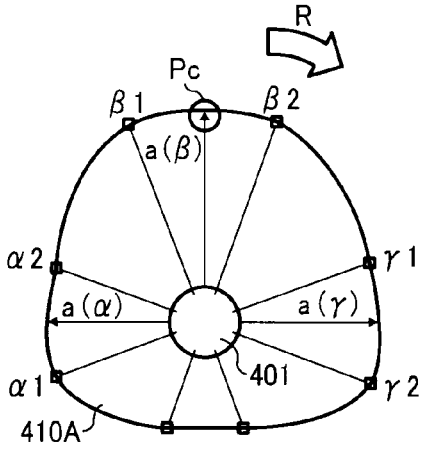
FIGS. 4A and 4B respectively illustrate shapes and angles of a left cam and a right cam according to one illustrative embodiment.
Figure 4B:
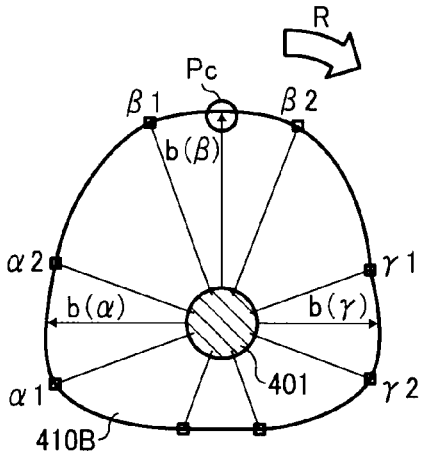

FIGS. 4A and 4B are side views respectively illustrating configurations and angles of the cams A and B viewed in the axial direction of the cam shaft 401 from a front side of the sheet P in FIGS. 1 and 2. FIG. 4A illustrates the cam A, and FIG. 4B illustrates the cam B, attached to the identical cam shaft 401 to which the cam A is attached. The cams A and B shown in FIGS. 4A and 4B are at an identical rotational angle. FIG. 4C is a timing diagram illustrating the relation between the rotational position and the cam lift amount of each of the cams A and B. In FIG. 4C, a solid line and a dotted line represent the cam lift amount of the cam A and that of the cam B, respectively. The cam lift amount means the amount by which the pressure roller 305 is pushed by the cam A or B via the cam follower 402, the lever 403, and the roller bearing 307.

The cams A and B shown in FIGS. 4A and 4B are plates cams and are substantially oval-shaped. The shape of each of the cams A and B is irregular and has multiple different length of radii between a center of the cam shaft 401 and its outer circumference. It is to be noted that an axis connecting an upper dead point with a lower dead point of each of the cams A and B is referred to as a long axis of the cam A or B.

Although the lift amounts of the cams A and B at upper dead points Pc are identical or similar, in rotational angle ranges, both sides of the long axis of each of the cams A and B have different shapes. That is, the outer circumferential shape or cam surface curvature rate of each of the cam A and B is different between left and right sides of its long axis. Accordingly, the lift amount of each of the cams A and B is different between rotational directions from the dead point. When the cam A is turned upside down, that is, faced down, its shape is congruent with that of the cam B faced up. The two eccentric plate cams A and B are attached to the respective end portions of the cam shaft 401 symmetrically relative to a virtual line (axis of symmetry) perpendicular to a center in the longitudinal direction of the cam shaft 401. The cams A and B may be symmetrical about the cam shaft 401. The cams A and B are disposed at symmetrical positions on separate parallel planes with their long axes aligned with each other.

When viewed in an identical direction as in FIGS. 4A and 4B, the shapes of the cams A and B are not identical, that is, the cams A and B are not symmetrical relative to a given plane. However, their dead points Pc correspond to each other. When the fixing belt 304 is transported normally without positional deviation, the cams A and B are at home positions (hereinafter also "non-correction position") at which the dead points Pc of the cams A and B face respective cam followers 402 and the lift amount of the cam A and B are constant and identical or similar, that is, the cam mechanism 400 does not perform deviation correction. It is to be noted that the upper dead point Pc is hereinafter also referred to as the reference contact point Pc. The cam shaft 401 is rotatable within a predetermined or given rotational range (angle range) in both a normal direction indicated by arrow R shown in FIGS. 4A and 4B and the reverse direction, and the cams A and B rotate as the cam shaft 401 rotates.

The shapes of the cams A and B shown in FIGS. 4A and 4B are described in further detail below. As shown in FIG. 4C, the lift amounts of the left cam A and the right cam B are identical or similar in a range from a rotational angle β1 to a rotational angle β2 (hereinafter "angle range β1 to β2") including the reference contact point Pc. That is, when a given point within the angle range β1 to β2 of each cam contacts the cam follower 402, the cams A and B can be at the above-described non-correction position. In the configurations shown in FIGS. 4A and 4B, the lift amounts of the left cam A and the right cam B are identical or similar also around the lower dead point. In angle ranges on both sides of the angle range β1 to β2, the circumferential shape of each of the cams A and B is different on both side of the long axis, that is, the lift amount is different between the right and the left. Additionally, the lift amount changes reversely between the cams A and B. In other words, in the case of the cam A, the lift amount a (β) is constant in the angle range β1 to β2 including the reference contact point Pc and drastically decreases continuously from the rotational angle β1 to a rotational angle α2. Then, the lift amount a(α) is constant from the rotational angle α2 to a rotational angle α1. This angle range α2 to α1 is also referred to a first correction range, that is, the cams A and B are at first correction positions when a given angle within the angle range α2 to α1 of each of the cams A and B pushes the pressure roller 305 via the follower 402, the lever 403, and the roller bearing 307.

By contrast, when the cam A rotates in the direction reverse to the normal direction from the home position, at which the rotational angle β1 to β2 presses the pressure roller 305, the lift amount of the cam A gradually decreases continuously and reaches a second correction position, at which a rotational angle γ1 presses the pressure roller 305. The lift amount a(γ) is constant from the rotational angle γ1 to a rotational angle γ2. This angle range 1 to γ2 is also referred to as a second correction range. The lift amount a(γ) at the second correction position is greater than the lift amount a(α). Thus, the circumferential shape of the cam A is different among the respective angle ranges on both sides of the upper dead point Pc, and changes in the lift amount is different between the right and the left.

The circumferential shape of the cam B, which is a counterpart of the cam A and attached to the cam shaft 401 coaxially with the cam A, is similarly different between the angle ranges on both sides of the angle range β1 to β2 in which the lift amount b(β) is constant. Changes in the lift amount in the angle ranges on the right and the left of the angle range β1 to β2 is complementary to those of the cam A. In other words, the charges in the lift amount of the cam B in both the normal direction and the reverse direction forms a curve reverse to that of the cam A. The lift amount of the cam B gradually decreases continuously from the rotational angle β1 to the rotational angle β2, and the lift amount b(α) is constant from the rotational angle α2 to a rotational angle α1 (first correction range).

Additionally, in the rotation range β2 to γ1, the lift amount of the cam B drastically decreases continuously, and the cam lift amount b(γ) is constant in the angle range γ1 to γ2 (second correction range). The lift amount b(γ) at the second correction position is smaller than the lift amount b(α). Additionally, the lift amount b(γ) of the cam B is smaller than the lift amount a(γ) of the cam A at the second correction position. The above-described cams A and B (401A and 401B) may be engaged with or fitted around the both end portions of the single cam shaft 401 symmetrically so that the upper dead points of the cams A and B in the circumferential direction coincide with each other, that is, at the angle shown in FIGS. 4A and 4B when viewed in the identical axial direction.

Figure 4C:
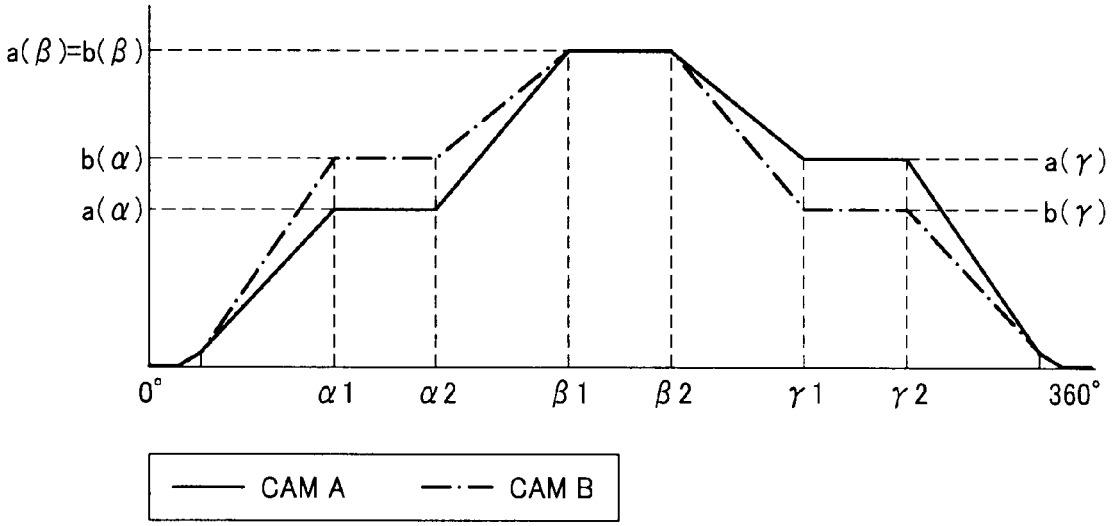
FIG. 4C is a timing diagram illustrating relations between a rotational position and a lift amount of the cams respectively shown in FIGS. 4A and 4B.

In the cam mechanism 400, as shown in FIG. 4C, when the left and right cams A and B rotate from a given rotational angle α1 through the rotational angle α2 to the rotational angle β1, the lift amount a(α), that is, the pressing force, of the cam A is smaller than the lift amount b(α) of the cam B. From the rotational angle α1 to the rotational angle α2, the lift amounts of the cams A and B are constant and the difference therebetween is constant. From the rotational angle α2 to the rotational angle β1, the lift amounts of the cams A and B change continuously, that is, decreases in the normal direction, and the cam B pushes the pressure roller 305 more strongly than the cam A does in this rotational range. From the rotational angle β1 to the rotational angle β2, the lift amounts of the cams A and B are identical or similar and constant, and accordingly the cams A and B push the pressure roller 305 with an identical or similar force, that is, the amounts by which the both end portions of the pressure roller 305 are respectively pushed by the cams A and B are identical or similar. However, in the angle range from the rotational angle β2 through the rotational angle γ1 to the rotational angle γ2, the lift amount a(γ) of the cam A is greater than the lift amount b(γ) of the cam B. In the angle range β2 to γ1, the difference in the pressing force of the left and right cams A and B changes continuously, and this difference decreases when the cams A and B rotate in the reverse direction. From the rotational angle γ1 to the rotational angle γ2, the lift amounts of the cams A and B are constant, that is, the difference therebetween is constant, and the cam A pushes the pressure roller 305 more strongly than the cam B does, which can be expressed as a(γ)>b(γ).

As a result, in the respective angle ranges except the range β1 to β2, the cam lift amount is different between the right and left end portions of the pressure roller 305. Accordingly, the amount by which the fixing belt 304 and the fixing roller 303 are pushed by the pressure roller 305 is different between the both portions of the fixing roller 303 in the axial direction. Additionally, the rotational direction of the cam shaft 401 determines which of the pressing force to one end portion and that to the other end portion is decreased. Needless to say, the lift amounts of the cams A and B across the entire rotational range is set within such a range that the pressing force of the pressure roller 305 is constantly within a range not to cause malfunction of the fixing device 300. In the configuration shown in FIGS. 4A through 4C, when the apparatus is not activated, the cams A and B are at such an angle that their lower dead points contact the respective cam followers 402 and their lift amounts are zero.

In short, in the angle range β1 to β2, the lift amounts of the cams A and B are identical or similar and constant, and accordingly the cams A and B push the pressure roller 305 with an identical or similar force. In the angle range α2 to α2, the lift amount a(α) of the cam A and the lift amount b(α) of the cam B are constant and a(α)<b(α), and the difference therebetween is also constant. The cam lift amounts depend on the positions of the cam mechanisms 400A and 400B. Similarly, in the angle range γ1 to γ2, the lift amount a(γ) of the cam A and the lift amount b(γ) of the cam B are constant and a(γ)>b(γ), and the difference therebetween is also constant. Therefore, even when it is difficult to control the rotational angle of the cam shaft 401 constantly because the performance of the actuator 405 is lower, the pressing force can be varied at a certain extent by driving the cam shaft 401 only to the correction positions.

It is to be noted that, although cams A and B are described above as if they are different cams, two identical plate cams can serve as both the left and right cams A and B in the present embodiment. In this case, one of the two identical cams is turned upside down and attached to the cam shaft 401 so that the two cams are symmetrical relative to the axis with the upper dead point of them aligned with each other, thus simplifying the management of the components of the cam mechanism 400.

Figure 5:
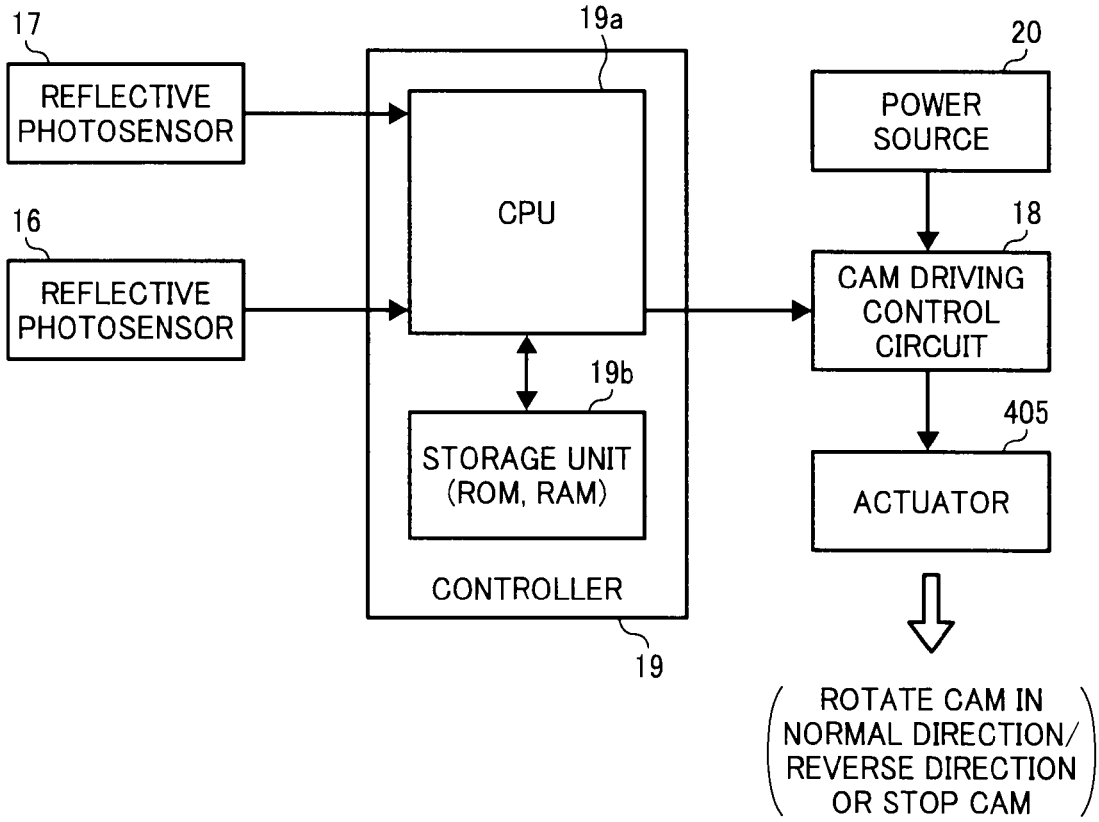
FIG. 5 is a control block diagram of a belt deviation correction mechanism according to one illustrative embodiment.

Driving control of the cam mechanism 400 is described below with reference to FIG. 5 that is a block diagram illustrating a configuration of a belt deviation correction mechanism including the deviation detector and a cam control mechanism to control driving of the cam mechanism 400. Referring to FIG. 5, the cam control mechanism includes a controller 19 that includes a central processing unit (CPU) 19*a* capable of various kinds of computing, a storage unit 19*b*, such as a read-only memory (ROM), a random-access memory (RAM), or nonvolatile memory, that stores various control programs, computing data, data on correction of positional deviation of the belts, and the like. The CPU 19*a* and the storage unit 19*b* are wired to each other to transmit data therebetween. Multiple reflective photosensors 16 and 17, together forming the deviation detector 306 shown in FIG. 2, as well as a cam driving control circuit 18 are connected to the CPU 19*a*. An output terminal of the cam driving control circuit 18 is connected to the actuator 405 shown in FIG. 3, and the cams 410A and 410B of the cam mechanisms 400 are rotated in the normal direction or the reverse direction, or stopped according to instructions from the CPU 19*a*.

The multiple reflective photosensors 16 and 17 are respectively disposed close to the right end portion and the left end portion in the width direction of the fixing belt 304 in FIG. 3 along the circumferential direction of the fixing belt 304. While the fixing belt 304 rotates in a predetermined width range (normal position), light emitted from each light-emitting element of the reflective photosensors 16 and 17 is not blocked by the fixing belt 304, and thus each reflective photosensor 16 or 17 is on. More specifically, a light-receiving element of each reflective photosensors 16 and 17 receives the light and outputs a predetermined or given voltage as a signal. By contrast, when the position of the fixing belt 304 in the width direction deviates from the predetermined width range, each reflective photosensor 16 or 17 is turned off and outputs no signal. From the viewpoint of fail-safe, the CPU 19*a* detects the positional deviation of the fixing belt 304 when the predetermined voltage is not output from each of the photosensors 16 and 17. The outputs from the reflective photosensors 16 and 17 are input to the CPU 19*a* via an interface, not shown, and thus the CPU 19*a* and the reflective photosensors 16 and 17 together form the deviation detector. It is to be noted that the relation between the on/off setting of the reflective photosensors and determination of the deviation may be reversed. Alternatively, mechanical switches or transmissive photosensors may be used instead of the reflective photosensors.

The controller 19 further includes known elements in addition to those shown in FIG. 5, and driving units, not shown, to drive the respective units of the apparatus are also connected to the controller 19 so that the controller 19 performs known operations to control them. For example, the controller 19 controls processes to produce proper images and adjusts toner supply amount to control toner supply. Descriptions of the known configurations and known functions of the controller 19 are omitted.

Next, deviation correction of the fixing belt 304 in the thrust direction according to the present embodiment is described in further detail below.

In the cam mechanism 400 according to the present embodiment, the rotational direction of the cam shaft 401 determines which of the pressing force to one end portion and that to the other end portion is decreased as described above. On the side on which the pressing force is decreased (hereinafter "pressure decrease side"), the pressure roller 305 as well as the fixing roller 303 slightly increase in a practical external diameter due to their elasticity. That is, both rollers slightly deform into circular cones. Accordingly, the pressure decrease side of the fixing belt 304, which is transported between the slightly-deformed rollers, rotates faster than the other side. Then, the fixing belt 304 slowly shifts in the thrust direction from the pressure decrease side to the opposite side where the pressing force by the cam mechanism 400 is greater, and thus the fixing belt 304 is adjusted to the normal position. This operation is referred to "belt deviation correction". Therefore, when the deviation of the fixing belt 304 from the normal position in the thrust direction exceeds a predetermined amount, output from the reflective photosensors 16 or 17 stops, and the CPU 19*a* detects the deviation of the fixing belt 304. Then, the CPU 19*a* instructs the cam driving control circuit 18 to rotate the cam shaft 401 in the direction to correct the deviation. Thus, the controller 19 compulsively moves the rotating fixing belt 304 to the side opposite the deviation in the thrust direction by rotating the cam shaft 401 according to the detection results generated by the deviation detectors 306 formed by the photosensors 16 or 17 so that the deviation of the fixing belt 304 can be corrected. The controller 19 waits until the CPU 19*a* detects the deviation no longer and then instructs the cam driving control circuit 18 to rotate the cam shaft 401 in reverse to revert to the normal position. Thus, the fixing belt 304 can revert to the normal position, that is, normal rotation state.

Figure 6:
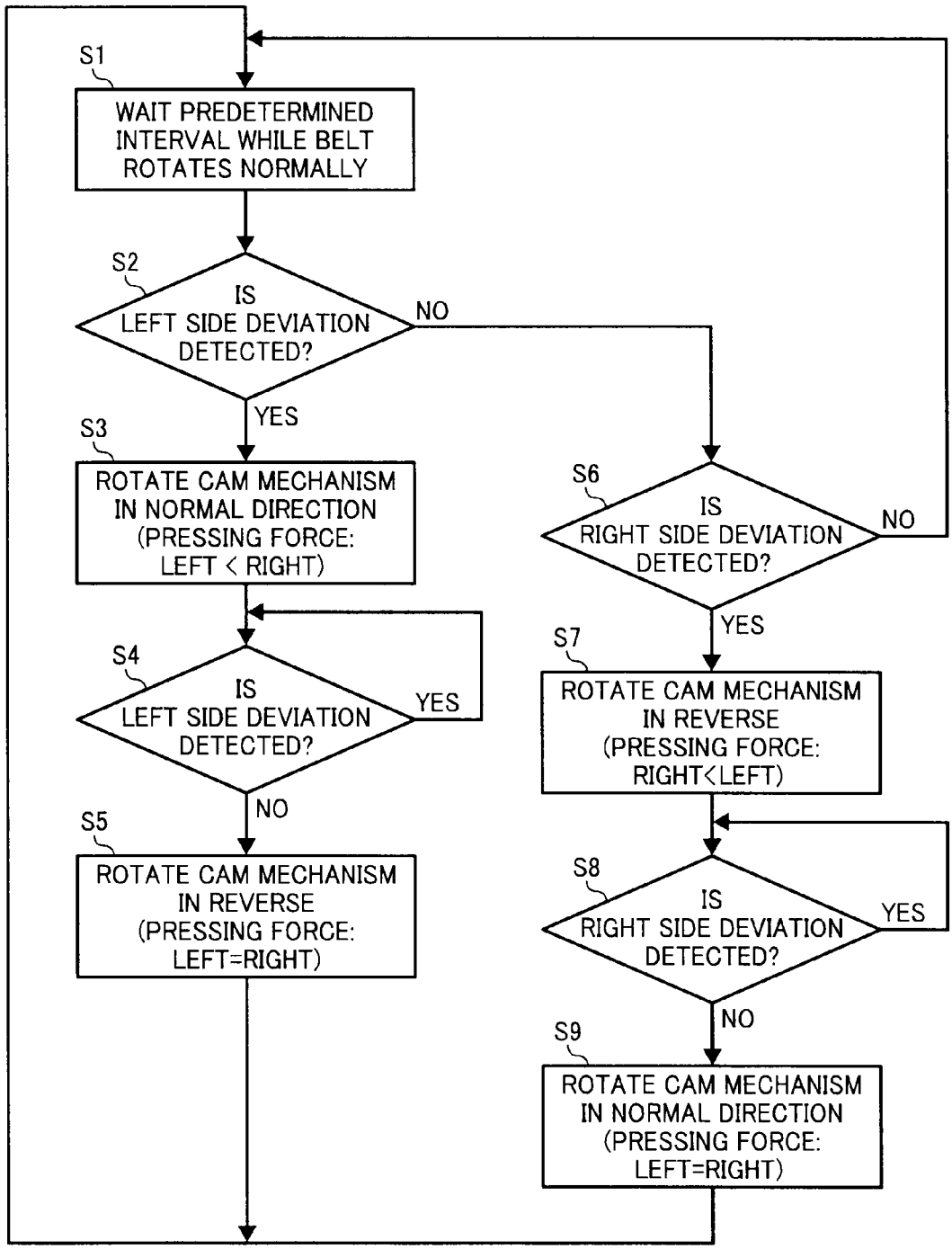
FIG. 6 is a flowchart of belt deviation correction according to one illustrative embodiment.

FIG. 6 is a flowchart of an operation to correct the positional deviation of the fixing belt 304, which is described below with reference to FIGS. 4A through 6.

While the fixing device 300 operates, at S1 the CPU 19*a* waits a predetermined or given time period (interval) when the fixing belt 304 rotates normally, that is, at the normal position (within in the predetermined width range) in the thrust direction. In this state, the cams 410A and 410B of the cam mechanism 400 is at the home positions (non-correction positions). At S2, the CPU 19*a* checks whether or not the reflective photosensors 16, disposed on the left in the thrust direction, output the signal, that is, whether or not the left side deviation of the fixing belt 304 is detected, at the predetermined intervals.

While the deviation of the fixing belt 304 is within the predetermined or given deviation range, the light-receiving element of each reflective photosensor 16 receives light and outputs the signal. That is, the deviation is not detected (NO at S2). Then, the process proceeds to S6 and the CPU 19*a* checks whether or not the reflective photosensors 17, disposed on the right in the thrust direction, output the signal, that is, whether or not the right side deviation of the fixing belt 304 is detected. While the deviation on the right in the thrust direction of the rotating fixing belt 304 is within the predetermined range, the light-receiving element of each reflective photosensor 17 receives light and outputs the signal. That is, the right side deviation is not detected (NO at S6). In this case, the fixing belt 304 deviates on neither the left nor right in the thrust direction, and the process returns to S1.

By contrast, at S2, when the reflective photosensor 16 does not output a signal, that is, the left side deviation of the fixing belt 304 is detected (YES at S2), at S3 the cam driving control circuit 18 rotates the cam mechanism 400 in the normal direction by a predetermined angle and then stops the cam mechanism 400. Thus, the cams 410A and 410B are set to the first correction positions (angle range $\alpha 2$ to $\alpha 1$ presses the pressure roller 305), and accordingly the pressing force of the cam 410A to the left portion of the fixing belt 304 is smaller than that of the cam 410B to the right portion of the fixing belt 304. Thus, positional adjustment begins, and the fixing belt 304 is shifted to the right in the thrust direction. Subsequently, at S4, the controller 19 monitors the positional adjustment and checks whether or not the reflective photosensors 16 output signals repeatedly while the reflective photosensors 16 do not output signals, that is, the left side deviation is detected (YES at S4).

When the position of the fixing belt 304 is adjusted to the normal position (NO at S4), at S5 the cam driving control circuit 18 rotates the cam mechanism 400 in the reverse direction by the above-described predetermined angle and then stops the cam mechanism 400. Thus, the cams 410A and 410B return to the non-correction angle (home position) from the first correction position, and accordingly the pressing force to the left portion of the fixing belt 304 equals that to the right portion of the fixing belt 304. Subsequently, the process returns to S1 and the positional deviation of the fixing belt 304 is repeatedly monitored at predetermined intervals.

In the above-described operation at S6, when the reflective photosensor 17 does not output a signal, that is, the right side deviation of the fixing belt 304 is detected (YES at S6), at S7 the cam driving control circuit 18 rotates the cam mechanism 400 in the reverse direction by a predetermined angle and then stops the cam mechanism 400. Thus, the cams 410A and 410B are set to the second correction position (angle range γ1 to γ2 presses the pressure roller 305), and accordingly the pressing force of the cam 410B to the right portion of the fixing belt 304 is smaller than that of the cam 410A to the left portion of the fixing belt 304. Thus, positional adjustment to move the fixing belt 304 to the left in the thrust direction begins. Subsequently, at S8, the controller 19 monitors the positional adjustment and checks whether or not the reflective photosensors 17 output signals repeatedly while the reflective photosensors 17 do not output signals, that is, the right side deviation is detected (YES at S8). When the position of the fixing belt 304 is adjusted to the normal position (NO at S8), at S9 the cam driving control circuit 18 rotates the cam mechanism 400 in the normal direction by the above-described predetermined angle and then stops the cam mechanism 400. Thus, the cams 410A and 410B return to the non-correction angle (home position) from the second correction position, and accordingly the pressing force to the left portion of the fixing belt 304 equals that to the right portion thereof. Subsequently, the process returns to S1 and the positional deviation of the fixing belt 304 is repeatedly monitored at predetermined intervals.

It is to be noted that it is preferable that the apparatus includes a function to repot an error to the user or to stop the apparatus when the position of the fixing belt 304 is not adjusted within a predetermined or given time period in the monitoring of the adjustment at S4 and S8. With such a function, when malfunction of the deviation detector or other function of the deviation correction occurs, the malfunction can be detected.

Second Embodiment

A second embodiment using cams A2 and B2 whose shape is different from that in the above-described first embodiment is described below with reference to FIG. 7 that is a timing diagram illustrating the relation between the rotational positions and the lift amounts of the cams A2 and B2. It is to be noted a drawing illustrating the shapes of the cams A2 and B2 is omitted.

Figure 7:
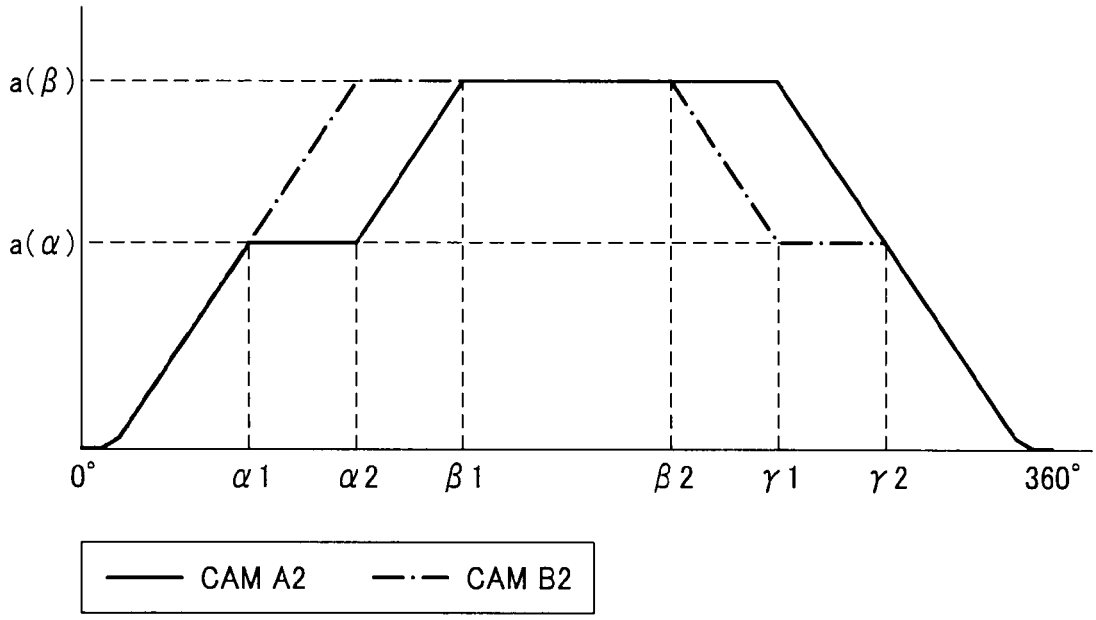
FIG. 7 is a timing diagram illustrating relations between rotational positions and lift amounts of a pair of right and left cams according to another embodiment.

A left cam A2 and a right cam B2 are symmetrical about the cam shaft 401 and configured to produce the timing diagram shown in FIG. 7. The configuration of the cam mechanism is similar to that of the first embodiment shown in FIGS. 2 through 6 except the shape of the cams, and thus the description thereof is omitted.

In FIG. 7, elements that substantially correspond to those shown in FIGS. 4A through 4C are given identical reference characters. Alto in the present embodiment, in the rotational angle range β1 to β2, the shapes of the left cam A2 and the right cam B2 are identical and there lift amounts are identical. However, differently from the cam 410A shown in FIG. 4A, the lift amount of the cam A2 does not change and kept at the lift amount a(β) from the rotational angle β2 to the rotational angle γ1 and decreases continuously from the rotational angle γ1. Then, similarly to the cam 410A shown in FIG. 4A, the lift amount of the cam A2 drastically decreases continuously from the rotational angle β1 to a rotational angle α2 and is constant from the rotational angle α2 to the rotational angle α1 (first correction range).

The shape and the rotational position of the cam B2, which is the counterpart of the cam A2, attached to the cam shaft 401 are symmetrical to those of the cam A2 relatively to the axis of the cam shaft 401. More specifically, as shown in FIG. 7, the lift amount of the cam B2 is constant and identical to the lift amount a(β) of the cam A2 in the angle range from the rotational angle β2 to the rotational angle α2 and drastically decreases continuously from the rotational angle β2 to the rotational angle γ1. The lift amount b(γ) of the cam B2 in the angle range from ↓2 to γ2 is constant and equals the lift amount a(α) of the cam A2 in the angle range α2 to α1. The lift amount b(α) of the cam B2 decreases continuously from the rotational angle β2, the other end of the angle range β2 to α2.

When the above-described cams A2 and B2 are adopted, similarly, in the respective angle ranges except the range including the reference contact point (upper dead point) Pc, the cam lift amount is different between the left and the right in the axial direction of the pressure roller 305. Accordingly, the pressing force to the fixing belt 304 and the fixing roller 303 is different between the both end portions in the axial direction. In particular, because the cams A2 and B2 are configured so that, in the angle ranges β1 to α2 and β2 to γ1, the difference in the lift amounts a(α) and b(α) changes linearly, the rotational angle can be proportional to the difference of the pressing force by the cams to the pressure roller 305 between the both end portions in the axial direction.

By setting the rotational position of the above-described right and left cams using the actuator, the difference in the pressure to the pressure roller 305 between the both end portions (difference in pressure in the nip portion) can be set more closely, and accordingly the positional deviation in the thrust direction of the fixing belt can be adjusted more closely. Thus, by continuously changing the difference in the lift pressure between the right and left cams in proportion to the rotational angle, the difference in the pressure to the pressure roller can be set more closely.

Third Embodiment

A third embodiment using a pair of right and left cams whose shapes are different from those in the above-described embodiments is described below with reference to FIG. 8.

In the above-described embodiments, when the right and left cams are rotated from the home position (non-correction position) in either the normal direction or the reverse direction, the sum of the pressing forces of the right and left cams is decreased, and simultaneously the pressing forces of the right and left cams are different. However, when the right and left cams are rotated from the non-correction position (angle range β1 to β2) in either the normal direction or the reverse direction, the sum of the pressing forces of the right and left cams may be increased, which is a specific feather of the present embodiment.

Figure 8:
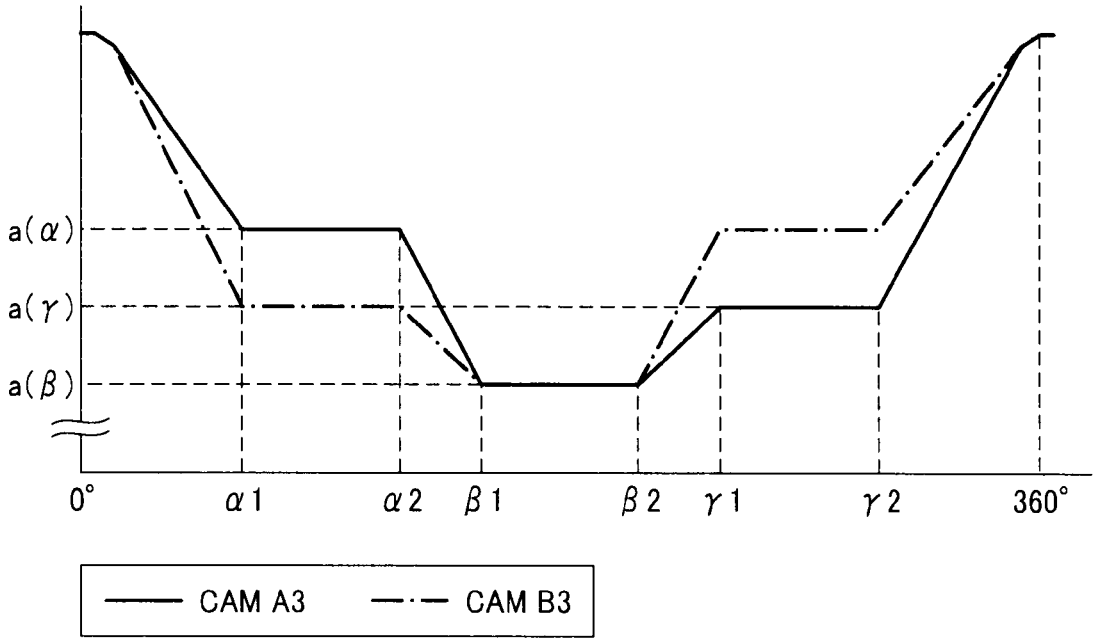
FIG. 8 is a timing diagram illustrating relations between rotational positions and lift amounts of a pair of right and left cams according to another embodiment.

FIG. 8 is a timing diagram illustrating the relation between the rotational positions and the lift amounts of cams A3 and B3 used in the preset embodiment. It is to be noted a drawing illustrating the shapes of the cams A3 and B3 is omitted.

When the cams A3 and B3 rotate from the non-correction positions to correct the positional deviation of the fixing belt 304 (shown in FIG. 2), the sum of the pressing forces of the cams A3 and B3 increases, and simultaneously their lift amounts increase differently, that is, the pressing forces of the cams A3 and B3 are different from each other. Thus, the positional deviation of the fixing belt 304 can be corrected as they rotate from the non-correction position.

In the above-described various embodiments, although the right cam and the left cam have different shapes, their lift amounts are identical or similar at a given rotational angle or in a given angle range. Therefore, the cam mechanism 400 can press both end portion of the fixing roller 305 with identical or similar force when the fixing belt 304 rotates normally without positional deviation. Additionally, because the lever 403 is used, the load to the actuator can be alleviated due to leverage effects.

The spring 404 can give similar effects to the actuator. It is to be noted that, when the cams are shaped as in the various above-described embodiments, differences in the pressing force to the pressure roller 305 between both end portions can be controlled by determining which of the lift amounts of the right and left cams is to be increased according to the rotational angle and the amount by which the lift amounts are changed according to the rotational angle.

Additionally, it is not necessary that the right cam and the left cam are exactly symmetrical relative to the cam shaft.

Features of the cams according to the various embodiments of the present invention are as follows: (A) The right and left cams are disposed substantially coaxially and have different shapes to each other. (B) When the right cam and the left cam are rotated from the non-correction position, at which a given point within the angle range β1 to β2 presses the pressure roller 305, in either the normal direction or the reverse direction, their lift amounts change differently with changes in the rotational angle, the greater of the lift amounts of the right and left cams is reverse between the rotational directions, and changes (increase or decrease) in the lift amount is reverse between the rotational directions.

Cams whose shapes are simpler, described below, can be also used in the cam mechanism described above.

Figure 9A:
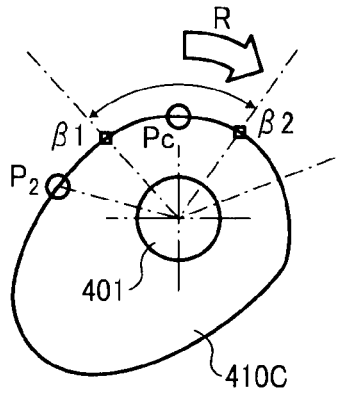
FIGS. 9A and 9B respectively illustrate shapes and rotational angles of a pair of right and left cams according to another embodiment.
Figure 9B:
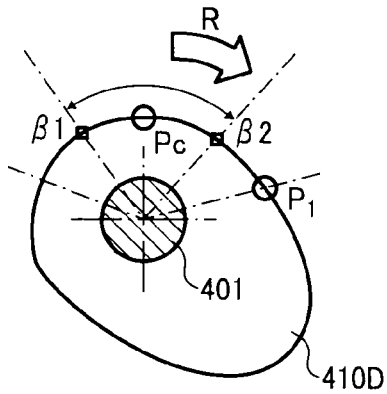

A fourth embodiment using such simpler cams is described below with reference to FIGS. 9A and 9B that respectively correspond to FIGS. 4A and 4B and illustrate a pair of a left cam 410C and a right cam 410D schematically. A drawing illustrating the relation between the lift amount and the rotational angle of the cams 410C and 410D is omitted.

Each of the cams 410C and 410D is a plate cam whose shape is a combination of a semicircle and a semiellipse. The cams 410C and 410D are attached to the both end portions of the identical cam shaft 401 at such an angle that one of two identical cams is turned upside down. In the present embodiment, a point Pc disposed in a center portion of an angle range where circumferential shapes of the cams 410C and 410D correspond to each other is a reference contact points, and the reference contact points Pc of the cams 410C and 410D contact the respective cam followers 402 when the deviation correction is not performed. In the angle range β1 to β2, the lift amounts of the cams 410C and 410D are constant and identical or similar. When the cams 410C and 410D rotate from angle range β1 to β2 in either the normal direction or the reverse direction, although the lift amount of one of these two cams is constant, the pressing force is different between the left cam 410C and the right cam 410D. The greater of the lift amount of the left cam 410C and that of the right cam 410D is reversed between the rotational directions. More specifically, in the normal direction, the lift amount of the cam 410C is constant while that of the cam 410D increases from the angle β2 to an angle $P_1$ (correction position). By contrast, in the reverse direction, the lift amount of the cam 410D is constant while that of the cam 410C increases to an angle $P_2$ (correction position).

Figure 10A:
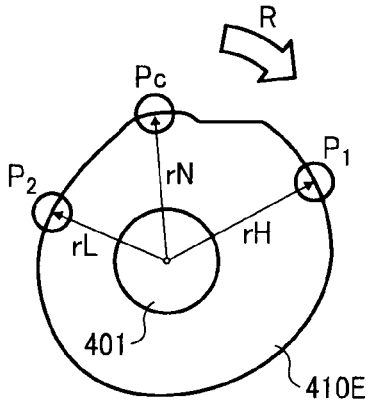
FIGS. 10A and 10B respectively illustrate shapes and rotational angles of a pair of right and left cams according to another embodiment.
Figure 10B:
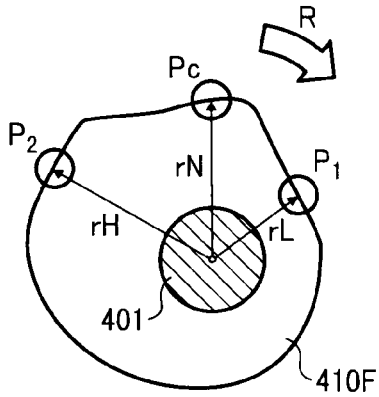

FIGS. 10A and 10B respectively illustrate shapes and rotational angles of cams according to a fifth embodiment. A drawing illustrating the relation between the lift amount and the rotational angle of the cams is omitted. In each of a left cam 410E and a right cam 410F shown in FIGS. 10A and 10B, a point Pc is the reference contact point that contacts the respective cam followers 402 when they are at non-correction positions, at which their lift amounts are rN. When the cams 410E and 410F rotate from the non-correction position in either the normal or reverse direction, the lift amount of one them increases and simultaneously the lift amount of the other cam decreases, and then the cams 410E and 410F reach respective correction positions. More specifically, when the cams 410E and 410F rotate in the normal direction to an angle $P_1$ (correction position), the lift amount of the cam 410E increases to a lift amount rH while that of the cam 410F decreases to a lift amount rL. By contrast, when the cams 410E and 410F rotate in the reverse direction to an angle $P_2$ (correction position), the lift amount of the cam 410E decreases to the lift amount rL while that of the cam 410F increases to the lift amount rH.

Thus, the pressing forces of the cams 410E and 410F differ to each other when the cams 410E and 410F rotate in the either direction. Additionally, the greater of the lift amounts of the cams 410E and 410F is revered when the cams 410E and 410F rotate in reverse.

Figure 11A:
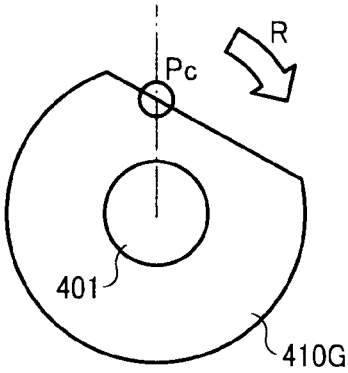
FIGS. 11A and 11B respectively illustrate shapes and rotational angles of a pair of right and left cams according to another embodiment.
Figure 11B:
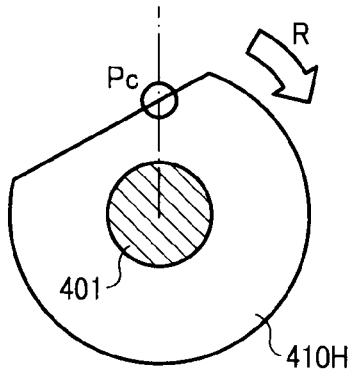

FIGS. 11A and 11B respectively illustrate shapes and rotational angles of cams according to a sixth embodiment. A drawing illustrating the relation between the lift amount and the rotational angle of the cams is omitted. A pair of left cam 410G and right cam 410H are plate cams and attached to the both end portions of the identical cam shaft 401 at such an angle that one of two identical cams is turned upside down. When a reference contact point Pc of each of the cams 410G and 410H contacts the cam follower 402, the cams 410G and 410H are at non-correction positions similarly to the above-described embodiments. When the cams 410G and 410H rotate in either the normal direction, indicated by arrow R shown in FIGS. 11A and 11B, or the reverse direction, the lift amount of one of the cams 410G and 410H increases and simultaneously the lift amount of the other cam decreases. Given rotational angles at which the pressing forces of the cams 410G and 410H are different can be set as the above-described correction positions. Thus, the pressing forces of the cams 410G and 410H differ to each other when the cams 410G and 410H rotate in the either direction. Additionally, the greater of the lift amounts of the cams 410G and 410H is revered when rotating in reverse.

Also in the configurations shown in FIGS. 9A through 11B the positional deviation of the fixing belt 304 in the thrust direction can be corrected by performed a similar control using the deviation detector 306 and the controller.

In the above-described first through fourth embodiments, the lift amounts of the right and left cams are constant in the non-correction position (angle range β1 to β2 including the reference contact position Pc). Additionally, in the first, third, fifth, and sixth embodiments, the lift amounts of the right and left cams are constant in the correction ranges. Thus, because the actuator need to rotate the cams only between the non-correction position and the correction positions to correct the positional deviation of the fixing belt 304, the actuator needs a smaller driving capacity and control can be easier. Additionally, durability of the actuator can be longer. Of course, the positional deviation of the fixing belt 304 can be corrected even when the cams do not have an angle range at which their lift amounts are constant although the load to the driving mechanism can increase in this case.

For example, the lift amount of the cams 410E and 410F shown in FIGS. 10A and 10B are constant only when the cams 410E and 410F are motionless at the non-correction position, that is, the reference contact point Pc contact the respective cam follower 402, and the lift amounts of the cams 410E and 410F are not constant in the correction range (correction positions). It is to be noted that, even when the cams do not have an angle range in which the lift amount is constant, by using a stepping motor disposed perpendicular to the cam shaft 401, instead of the actuator, and a warm gear disposed between the stepping motor and the cam shaft, the warm gear can stop the cams. More specifically, although the cams are likely to rotate due to repulsion force of the pressure roller even when it is desired to stop the cams, the warm gear does not transmit the rotational force from the downstream side in the direction of rotation, and thus the warm gear can serve as a stopper. In this configuration, because the velocity reduction rate is larger, the position of the cam can be controlled more closely although the rotational velocity of the cam is reduced.

Although the pressure adjustment unit (cam mechanism 400) is provided only on the side of the pressure roller 305 in the above-described various embodiments, the pressure adjustment unit according to any of the above-described embodiments may be provided on the side of the fixing roller 302 or both of the pressure roller 305 and the fixing roller 302 to adjust the pressure between the two rollers. Similar effects can be also attained in such cases.

It is to be noted that, when the cam is shaped so that the lift amount increases or decreases depending on the rotational direction, like cams 410E and 410F shown in FIGS. 10A and 10B, only a single cam may be used. More specifically, one end of the roller shaft 401 may be swingably attached to the housing or the like, and the cam mechanism may be provided in only the other end portion. Also in this case, when deviation correction is not necessary, the cam is set at the home position, and the reference contact point Pc contacts the cam follower 402. Accordingly, the pressure between the fixing roller and the pressure roller is similar between the both end portions. By rotating the cam from the home position in either the normal direction or the reverse direction according to the output from the deviation detector, the pressure between the two rollers can be varied between the both end portions, and thus the deviation of the fixing belt in the thrust direction can be corrected.

It is to be noted that, instead of eccentric cams, sector gears may be used to change the pressure between the first belt supporter and the pressure member that presses against the first belt supporter via the endless belt.

The above-described embodiments concern the fixing device including the belt driving mechanism in which the pressure roller 305, serving as the pressure member, presses against the fixing roller 303, serving as the first belt supporter, via the fixing belt 304, serving as the endless belt, thus forming the nip therebetween, and the cam mechanism 400 serving as the pressure adjustment unit adjusts the pressure between the pressure roller 305 and the fixing roller 303 to correct the deviation of the fixing belt 304 in the thrust direction. However, the belt supporters as well as the endless belt whose deviation is corrected is not limited to those described above, and additionally, the belt driving mechanism according to the above-described embodiments may be used in other devices than fixing devices.

For example, in the fixing device, the number of the belt supporters around which the endless belt is wound is not limited to two.

Figure 13:
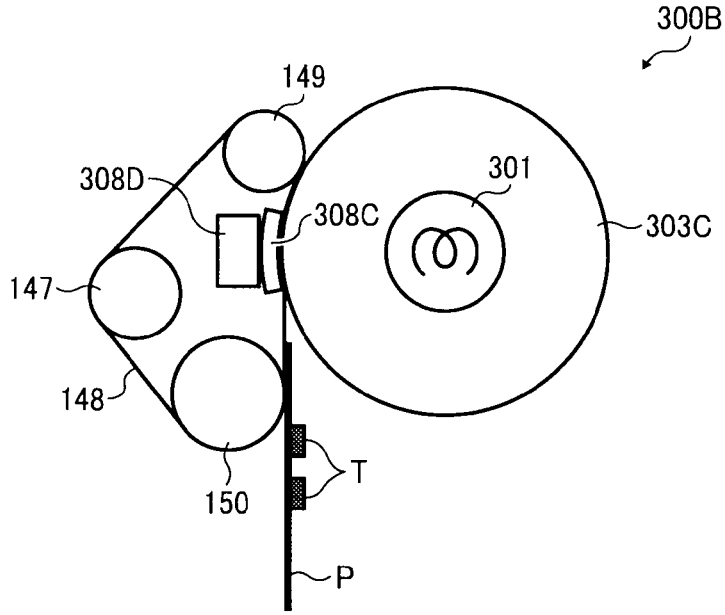
FIG. 13 illustrates a fixing device according to another embodiment.

The position of the first belt supporter is not limited to a corner portion of the circumference of the belt as shown in FIG. 2 where the rotational direction of the belt is changed. Alternatively, the position of the first belt supporter may be in a substantially linear portion of the circumference of the belt as shown in FIG. 13. Considering fixing quality, the belt deviation correction may be performed while the fixing belt is rotating without carrying sheets, such as sheet intervals during continuous feeding of sheets. Alternatively, continuous feeding of sheets may be stopped and then the belt deviation correction may be performed while the fixing belt rotates without sheets.

The belt deviation correction mechanism according to the above-described embodiments may be used other types of fixing devices.

The belt deviation correction mechanism according to the above-described embodiments is applicable to any fixing devices including an endless belt supported by belt supporters. For example, the belt deviation correction mechanism is also applicable to a configuration shown in FIG. 12 in which the pressure member is a pressure belt wound around the pressure roller, and the toner image is fixed on the sheet while the sheet passes between a nip where the pressure belt presses against the fixing belt.

Figure 12:
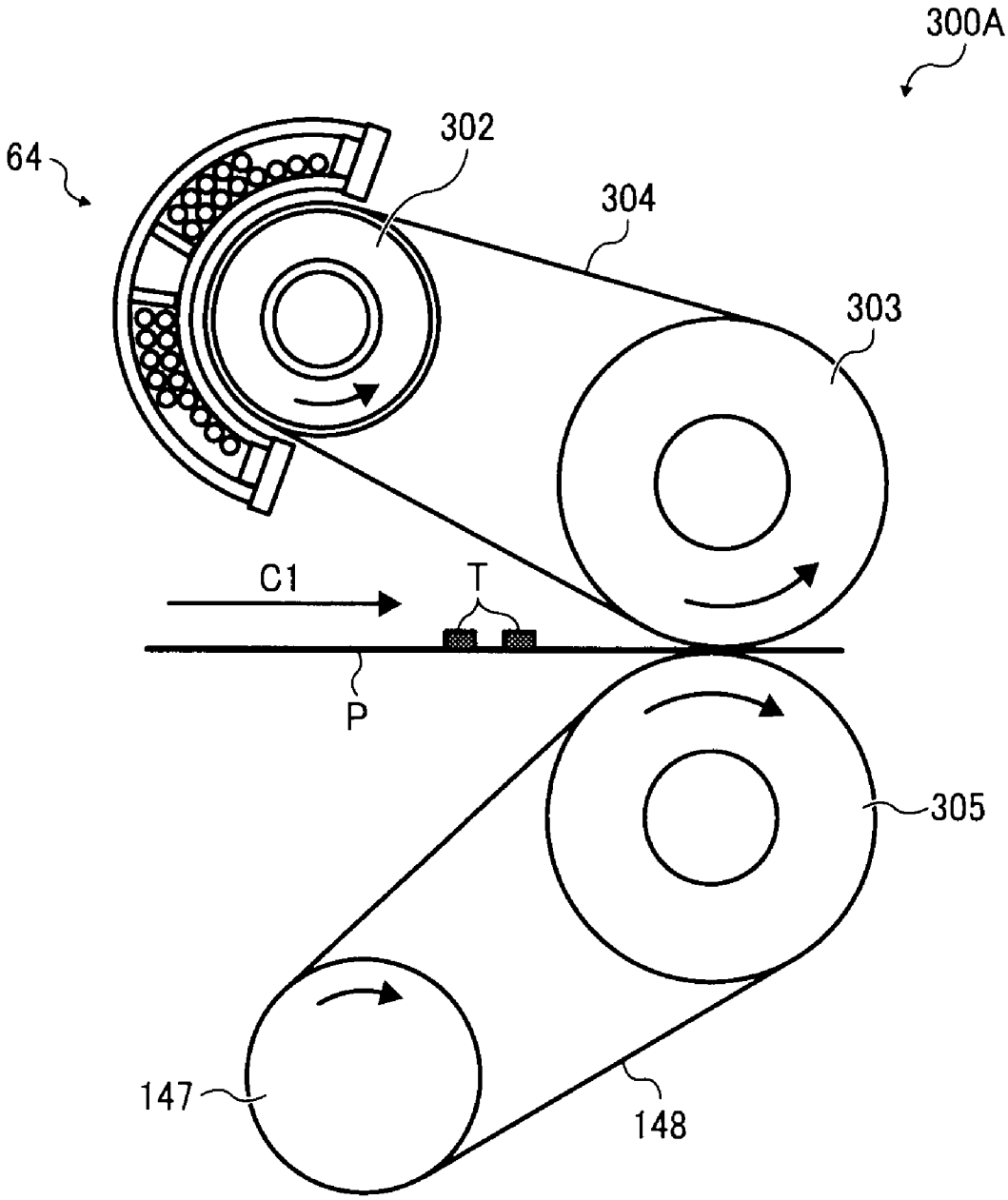
FIG. 12 illustrates a fixing device according to another embodiment.

In FIG. 12, a fixing device 300A includes a fixing belt 304 wound around a fixing roller 300 as well as a heating roller 302, an induction heating unit 64 to heat the heating roller 302, and a pressure belt 148 wound around a pressure roller 305 as well as a support roller 147.

Figure 14:
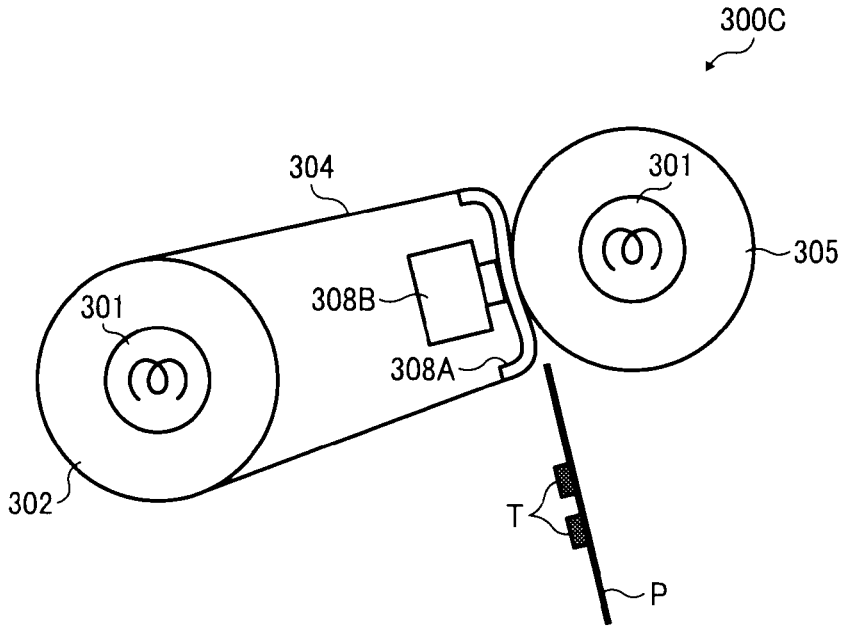
FIG. 14 illustrates a fixing device according to another embodiment.

Alternatively, the belt deviation correction mechanism is applicable to a configuration in which the endless belt whose deviation is corrected is not the fixing belt but the pressure belt wound around multiple belt supporters. Yet alternatively, one of the pressure member and the belt supporter pressing against each other via the endless belt may be not a roller but a pad as shown in FIGS. 13 and 14.

In a fixing device 300B shown in FIG. 13, a pressure pad 308C, extending in the axial direction of a fixing roller 303C, presses against the fixing roller 303C, inside which a heater 301 is provided, via a pressure belt 148. The pressure pad 308C is formed of a heat-resisting material and is supported by a supporter 308D. The pressure belt 148 is wound around support rollers 148, 149, and 150 in addition to the pressure pad 308C. In a fixing device 300C shown in FIG. 14, a fixing belt 304 is wound around a fixing pad 308A, extending in the axial direction of a fixing roller 303C, and a heating roller 302, inside which a heater 301 is provided, and the fixing pad 308A is supported by a supporter 308B. A pressure roller 305 presses against the fixing pad 308A via the fixing belt 304. In this configuration, another heater 301 is provided in the pressure roller 305.

In those configurations, the pressure adjustment unit can be disposed on either the side of the belt supporter or the side of the pressure member pressing against each other, and the position of the belt in the thrust direction can be adjusted by performing an operation similar to the above-described deviation correction.

Regarding the deviation detector, when a detector, such as light-receiving arrays, that outputs analog signals or multiple stepwise signals according to the position of the end portion of the belt in the width direction is used, the detector may be provided on only one side in the width direction.

Additionally, in the case of fixing devices, the positional deviation of the belt can be corrected using the fixing nip that is originally included in the fixing device and the above-described deviation correction mechanism.

Numerous additional modifications and variations are possible in light of the above teachings. It is therefore to be understood that, within the scope of the appended claims, the disclosure of this patent specification may be practiced otherwise than as specifically described herein.

What is claimed is:

1. A belt driving mechanism, comprising:

a first belt supporter and a second belt supporter;

an endless belt rotatably wound around the first belt supporter and the second belt supporter;

a driving source connected to one of the first belt supporter and the second belt supporter to rotate the endless belt;

a pressure member that presses against the first belt supporter via the endless belt, forming a nip therebetween;

a deviation detector to detect a deviation of the endless belt in a thrust direction of the endless belt;

a cam mechanism to adjust pressure between the pressure member and the first belt supporter between both end portions thereof in the thrust direction of the endless belt, the cam mechanism including:

a rotary cam shaft extending in a direction parallel to the thrust direction of the endless belt, a first pressure change member attached to the cam shaft, to press a first end portion of one of the first belt supporter and the pressure member in the thrust direction toward the nip, and a second pressure change member disposed coaxially with the first pressure change member, to press a second end portion opposite the first end portion of one first belt supporter and the pressure member and to rotate in synchronization with the first pressure change member, the first pressure change member of irregular shape, having multiple different lengths of radii between a center portion of the cam shaft and an outer circumference of the first pressure change member; and a controller to change a rotational position of the first pressure change member by rotating the cam shaft according to a detection result generated by the deviation detector, wherein the second pressure change member has a shape different from that of the first pressure change member, the first pressure change member and the second pressure change member have a reference point where lift amounts of the first pressure change member and the second pressure change member are substantially identical, and the lift amounts of the first pressure change member and the second pressure change member change differently according to a rotational angle of the first pressure change member and the second pressure change member from the reference point.

2. A fixing device to fix a toner image on a recording medium, comprising:

a fixing member to be heated by a heating source;

a pressure member that presses against the fixing member, forming a nip therebetween;

an endless belt rotatably sandwiched between the pressure member and the fixing member, wound around a belt supporter and one of the fixing member and the pressure member disposed in parallel to the belt supporter;

a driving source connected to one of the belt supporter, the pressure member, and the fixing member to rotate the endless belt;

a deviation detector to detect a deviation of the endless belt in the thrust direction;

a cam mechanism to adjust pressure between the fixing member and the pressure member in both end portions thereof in the thrust direction of the endless belt, the cam mechanism including:

a rotary cam shaft extending in a direction parallel to the thrust direction of the endless belt, and a first pressure change member attached to the cam shaft, to press a first end portion in the thrust direction of one of the fixing member and the pressure member to the nip, the first pressure change member of irregular shape, having multiple different lengths of radii between a center portion of the cam shaft and an outer circumference of the first pressure change member;

a controller to change a rotational position of the first pressure change member by rotating the cam shaft according to a detection result generated by the deviation detector; and a second pressure change member disposed coaxially with the first pressure change member, to press a second end portion opposite the first end portion of one of the fixing member and the pressure member and to rotate in synchronization with the first pressure change member, wherein the second pressure change member has a shape different from that of the first pressure change member, the first pressure change member and the second pressure change member have a reference point where lift amounts of the first pressure change member and the second pressure change member are substantially identical, and the lift amounts of the first pressure change member and the second pressure change member change differently according to a rotational angle of the first pressure change member and the second pressure change member from the reference point.

3. The fixing device according to claim 2, wherein one of the fixing member and the pressure member is a roller, the other of the fixing member and the pressure member is an elastic pad, and the roller and the elastic pad press against each other via the endless belt.

4. The fixing device according to claim 2, wherein the endless belt is a pressure belt winding around the pressure member as well as the belt supporter.

5. The fixing device according to claim 2, wherein the first pressure change member presses a journal portion of one of the fixing member and the pressure member pressing against each other via the endless belt.

6. The fixing device according to claim 2, wherein the first pressure change member is a plate cam.

7. The fixing device according to claim 2, further comprising an angle range in which the lift amount of the first pressure change member is constant.

8. The fixing device according to claim 2, further comprising:

an angle range $\alpha$ in which $A>B$, disposed on one side of the reference point; and an angle range β in which A<B, disposed on an opposite side of the reference point from the angle range α;

wherein A and B respectively represent the lift amounts of the first pressure change member and the second pressure change member.

9. The fixing device according to claim 8, wherein between a normal direction and a reverse direction of rotation of the cam shaft, the lift amount of only one of the first pressure change member and the second pressure change member changes according to the rotational angle of the first pressure change member and the second pressure change member from the reference point.

10. The fixing device according to claim 8, wherein the lift amount of each of the first pressure change member and the second pressure change member changes inversely between rotational directions of the cam shaft.

11. The fixing device according to claim 2, wherein the first pressure change member is attached to a first end portion of the cam shaft, the second pressure change member is attached to a second end portion opposite the first end portion of the identical cam shaft to which the first pressure change member is attached, and a single driving source rotates both the first pressure change member and the second pressure change member.

12. The fixing device according to claim 2, further comprising an angle range in which a difference between the lift amounts of the first pressure change member and the second pressure change member is constant.

13. The fixing device according to claim 2, further comprising an angle range in which a difference between the lift amounts of the first pressure change member and the second pressure change member changes continuously.

14. The fixing device according to claim 2, wherein the shapes of the first pressure change member and the second pressure are symmetrical about the cam shaft.

15. The fixing device according to claim 2, wherein the controller rotates the cam shaft while the endless belt is rotating.

16. The fixing device according to claim 2, wherein the cam mechanism further comprises a lever including a hinged first end portion and a second end portion opposite the first end portion pressed by the first pressure change member.

17. The fixing device according to claim 16, wherein the cam mechanism comprises a bias member connected to the lever, to bias the lever toward the nip between the fixing member and the pressure member.

18. An image forming apparatus in which the fixing device according to claim 2 is incorporated.

* * * * *